US008038581B1

(12) United States Patent
Sudeith

(10) Patent No.: US 8,038,581 B1
(45) **Date of Patent: *Oct. 18, 2011**

(54) CLIMBING WALL ASSEMBLY

(75) Inventor: Timothy S. Sudeith, Edina, MN (US)

(73) Assignee: Everlast Climbing Industries, Inc., Mendota Heights, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/460,285

(22) Filed: Jul. 16, 2009

Related U.S. Application Data

(63) Continuation-in-part of application No. 11/280,899, filed on Nov. 16, 2005, now Pat. No. 7,563,202, which is a continuation-in-part of application No. 10/236,728, filed on Sep. 6, 2002, now Pat. No. 7,056,266.

(60) Provisional application No. 60/628,458, filed on Nov. 16, 2004, provisional application No. 60/317,726, filed on Sep. 6, 2001.

(51) Int. Cl.
*A63B 9/00* (2006.01)

(52) U.S. Cl. ..... 482/37

(58) Field of Classification Search ..... 482/35–37
See application file for complete search history.

(56) References Cited

U.S. PATENT DOCUMENTS

| | | | | |
|---|---|---|---|---|
| 4,155,887 | A * | 5/1979 | Hetson | 524/27 |
| 5,254,058 | A | 10/1993 | Savigny | |
| 5,609,788 | A * | 3/1997 | Deetz | 252/62.54 |
| 5,732,954 | A | 3/1998 | Strickler et al. | |
| 5,944,634 | A | 8/1999 | Neves | |
| 6,074,327 | A | 6/2000 | Franklin | |
| 6,083,142 | A | 7/2000 | Wilson | |
| 6,231,482 | B1 | 5/2001 | Thompson | |
| 6,383,560 | B1 * | 5/2002 | Ledbetter | 427/180 |
| 6,705,972 | B1 | 3/2004 | Takano et al. | |
| 6,709,365 | B2 | 3/2004 | Zeilinger | |
| 7,114,592 | B1 | 10/2006 | Gibson et al. | |
| 7,563,202 | B1 * | 7/2009 | Sudeith | 482/37 |
| 2008/0008821 | A1 * | 1/2008 | Sandor | 427/11 |

* cited by examiner

*Primary Examiner* — Fenn Mathew
(74) *Attorney, Agent, or Firm* — Eggink & Eggink; Anthony G. Eggink; Katrina M. Eggink

(57) ABSTRACT

A climbing wall assembly for educational and recreational purposes. The climbing wall assembly has a plurality of adjacently positioned wall panels, each having an exterior paint/aggregate textured surface adapted for educational purposes. A plurality of wall apertures are provided for mounting hand hold structures so that a plurality of climbing paths may be provided. Markable paint/aggregate climbing wall surfaces are also provided. Removable magnetic and metallic educational elements may also be utilized by the climbers. A paint/aggregate layer having metallic or magnetic particles mixed therein may be utilized to provide the magnetic climbing wall surface and to provide magnetic qualities to climbing wall components.

19 Claims, 7 Drawing Sheets

CLIMBING WALL ASSEMBLY

This application is a Continuation-in-Part of pending U.S. patent application Ser. No. 11/280,899, filed on Nov. 16, 2005 U.S. Pat. No. 7,563,202 which claims the benefit of U.S. Provisional Patent Application Ser. No. 60/628,458 filed on Nov. 16, 2004, and which is a Continuation-in-Part of application Ser. No. 10/236,728, filed on Sep. 6, 2002, now U.S. Pat. No. 7,056,266 issued on Jun. 6, 2006, and which claims the benefit of U.S. Provisional Patent Application Ser. No. 60/317,726, filed on Sep. 6, 2001.

BACKGROUND OF THE INVENTION

The present invention relates generally to climbing wall assemblies and particularly to climbing wall assemblies that are utilized for educational and recreational purposes. More particularly, this invention relates to climbing wall assemblies comprised of wall panels having exterior surface structures adapted for use with associated removable educational element structures. This invention further relates to climbing wall surfaces formed of paint/aggregate mixtures.

The rock climbing and bouldering sports have become increasingly popular activities. As a result, artificial climbing and bouldering walls are increasingly being used for training purposes by climbers. The climbing wall assemblies of the present invention are provided to introduce children into the climbing sports in a safe and educational manner.

The climbing wall assemblies of the invention are constructed and arranged for educational climbing wall activities. The climbing wall assemblies are comprised of versatile, cooperating elements which provide the ability to create a plurality of climbing routes to be used by climbers. The elements may be easily changed and adjusted to provide a variety of educational climbing activities. The climbing wall assemblies of the invention are economical to manufacture, easy to install and are versatile in use.

The climbing wall assemblies of the invention may be comprised of wall panels to create climbing walls. The invention further provides a wall climbing surface which is textured to provide a natural rock look and feel. Wall plates and hand holds are mounted to the wall panels or climbing wall structures. The wall panels are constructed and arranged to be mounted to a load bearing structure such as a wall of a building or a free standing structure, for example. The climbing wall assemblies may include adjoining writing board wall panels having smooth surfaces, i.e., a "chalkboard" or a "white board" surfaces, including those having metallic and magnetic properties for receiving erasable markings. The climbing wall assemblies may include adjoining molded wall panels having metallic or magnetic surface properties for use with magnetic or metallic educational elements. Alternatively, a paint or coating layer having metallic or magnetic particles may be applied to a climbing wall or other climbing wall component, i.e., a hand hold, wall plate or educational element structure. The paint or coating layer may also include an aggregate so as to provide a textured surface for the climbing wall and to climbing components used in connection with the climbing wall.

The climbing wall assembly may also incorporate the use of wall plates and hand holds which preferably are molded of a plastic composition and which may incorporate metallic particles for use with magnetic educational elements. The wall panels, wall plates and hand holds are all constructed and arranged to provide a versatile and adjustable climbing wall assembly that permits a plurality of climbing routes to be created and which allows markings to be made on the wall panel surfaces and magnetic or metallic elements to be easily placed and moved by climbers for recreational and educational use.

Although the prior art teaches the use of wall structures and hand holds that are used for climbing purposes and other prior art discloses the use of magnetic elements with respect to hand holds, these prior art devices are restricted and limited in use and do not disclose or suggest the climbing wall assembly and components of the present invention. The combination of the molded wall panels, hold or wall plates and hand and foot hold structures having markable and erasable surfaces and/or surfaces with metallic or magnetic properties for use with magnetic or metallic elements are not provided in the prior art. A need exists in the wall climbing art for such climbing wall assemblies. There is a further need to provide a magnetic surface on a climbing wall in an inexpensive, effective and easy manner and to provide a climbing wall with a textured exterior surface having the look and feel of a natural climbing environment.

The present invention provides a climbing wall assembly that is versatile and permits numerous climbing routes to be created and utilized for educational purposes. Further, the present invention provides inexpensive and easy to apply magnetic and metallic surfaces to climbing wall surfaces and associated components.

SUMMARY OF THE INVENTION

The magnetic climbing wall assembly of the invention comprises a plurality of wall panels, wall plates, hand holds and educational elements that permit numerous climbing routes to be created and used for educational purposes. The climbing wall assembly may include adjoining wall panels with markable surfaces that are adapted for easy erasure and/or molded wall panels having a surface with metallic or magnetic properties for use with magnetic or metallic, educational elements. The climbing wall assembly further comprises the use of wall plates and hand holds which are preferably molded of a plastic composition which may incorporate embedded metallic or magnetic particles for use with educational elements having magnetic or metallic properties. The invention further comprises a metallic or magnetic coating or paint layer for a climbing wall structure surface and/or for associated climbing wall components, such as hand holds, wall plates, educational elements and the like. The paint layer may also provide a writing surface for chalk and other markings to simulate blackboard and whiteboard surfaces.

The educational climbing wall assembly of the invention comprises wall panels, wall plates and hand holds which are constructed and arranged to provide a climbing wall assembly that permits climbing routes to be created and changed and which permit associated magnetic and metallic structures to be placed and moved on the wall assembly elements for recreational and educational purposes.

The wall panels of the invention include molded structures which have mounting means to receive wall plates and hand holds at a plurality of predetermined positions. Alternative wall panel structures are also disclosed. Further, the wall panels have exterior surfaces which may receive chalk markings, magnetic or metallic structures and adhesive structures, such as stickers, tape, laminates, and easy to remove markings such as those from a dry erase marker or write-on and wash off marker. Further provided by this invention are methods of manufacturing the wall panels, wall plates and hand hold structures of the invention.

The wall or route plates used in the climbing wall assembly of the invention are designed and constructed for use in educational climbing wall activities. The wall or route plates may be mounted between the climbing wall and the climbing hand hold and/or mounted separately to the climbing walls. For example, 30-50 route plates may be used on a 40-foot traverse climbing wall structure and to provide a number of designated climbing routes, i.e., beginner, intermediate and advanced routes.

The climbing routes may be identified by varying colors, geometric shapes and/or markings to provide young climbers with the ability to improvise various climbing games using colors, numbers, letters, words, shapes, animal figures, maps, pictures and symbols, i.e. mathematical symbols and the like.

The wall plates may also be provided with apertures to receive inset discs and which are preferably brightly colored and are easily visible to climbers. The different colored discs may be utilized to differentiate varying climbing routes. For example, hand holds that are marked with green discs may provide a beginner climbing route and hand holds that are marked with red discs may provide an advanced climbing route. Alternatively, the colors may be used to signify or identify a particular climber that created the route. Route setting and resetting is an integral part of utilizing the climbing wall assembly of the invention for educational and recreational purposes.

Another application for the route wall plates may involve using lettered and numbered discs. For example, discs having a complete alphabet set (A-Z), numbers 0-9, words and symbols, i.e. mathematical, musical, geometrical, geographical and scientific symbols, may be utilized in the present invention. Use of the numerical and letter discs facilitates spelling and number games on the climbing wall and eliminates the difficulty and inconvenience of creating and using paper letters and numbers tucked under the hand holds. The letters and numbers on the discs are preferably raised and textured and mounted on a geometrically shaped body, such as a rigid urethane, flexible rubber or other body structures, so that the discs may be easily inserted and removed by the climber. The discs may be molded in a one piece structure (body and letter or number) such as of a molded urethane structure or the like, for example.

A climbing wall improvement provided by the present invention includes a climbing wall surface having magnetic or metallic properties wherein the magnetic or metallic properties are provided by applying a paint layer or coating having particles with metallic or magnetic properties mixed therein. The paint may be acrylic, enamel or other known type of paint media, which may also provide a writable surface. The paint layer may be sprayed, brushed, rolled or applied in any known manner on the surface of wall panels, i.e., on plywood or concrete walls, for example. The coating or paint layer may be applied to other surfaces or substructures relating to climbing walls, for example, onto wall plates, hand holds or a block or concrete gymnasium wall. The magnetic or metallic climbing wall surface layer permits educators and students to place and remove magnetic or metallic objects for educational uses. Magnetic or metallic objects may also be used with climbing routes for math and language related activities, for example.

The present invention further provides climbing wall surfaces having a texture with the look and feel of natural rock. The textured surface may be provided by an aggregate substance in a paint formulation that is either sprayed, brushed, rolled or trowelled onto a climbing wall panel, for example. The paint or coating/aggregate may also be utilized to mold climbing walls and related components. The paint/aggregate mixture may include metallic or magnetic particles to provide a climbing wall surface that may be utilized with magnetic/metallic educational elements.

The textured climbing wall surfaces provide advantages to the climbing wall art including a natural rock look and feel, the stabilization of hand holds by providing increased frictional wall surfaces which aid in securing the hand holds and permitting climbers to utilize smearing climbing techniques. The textured surfaces may also be provided for climbing wall components, such as wall plates and/or handhold structures. The textured surfaces may also be writable.

These and other benefits of this invention will become clear from the following description by reference to the drawings.

DESCRIPTION OF THE PREFERRED EMBODIMENTS

The magnetic climbing wall assembly of the invention comprises a plurality of wall panels, wall plates, hand holds and educational elements that permit numerous climbing routes to be created and used for recreational and educational use. The climbing wall assembly includes a climbing wall such as one formed by adjoining molded wall panels having exterior surfaces adapted to receive easily erasable markings and/or having metallic or magnetic properties for use with magnetic or metallic, educational elements. The climbing wall assembly further comprises the use of wall plates and hand holds which may be molded of a polymeric or plastic composition which incorporate embedded metallic or magnetic particles for use with magnetic or metallic educational elements. The magnetic or metallic and writable surface qualities of the wall panels, wall plates and hand holds may also be provided by a paint or coating layer which has metallic or magnetic particles mixed therein.

In summary, the educational climbing wall assembly of the invention comprises wall panels, wall plates and hand holds that may be constructed and arranged to provide a climbing wall assembly having the ability of numerous climbing routes to be created and that permits magnetic or metallic pieces, stickers, laminates, chalk, markers and the like to be placed and moved for recreational and educational use.

Figure 1:
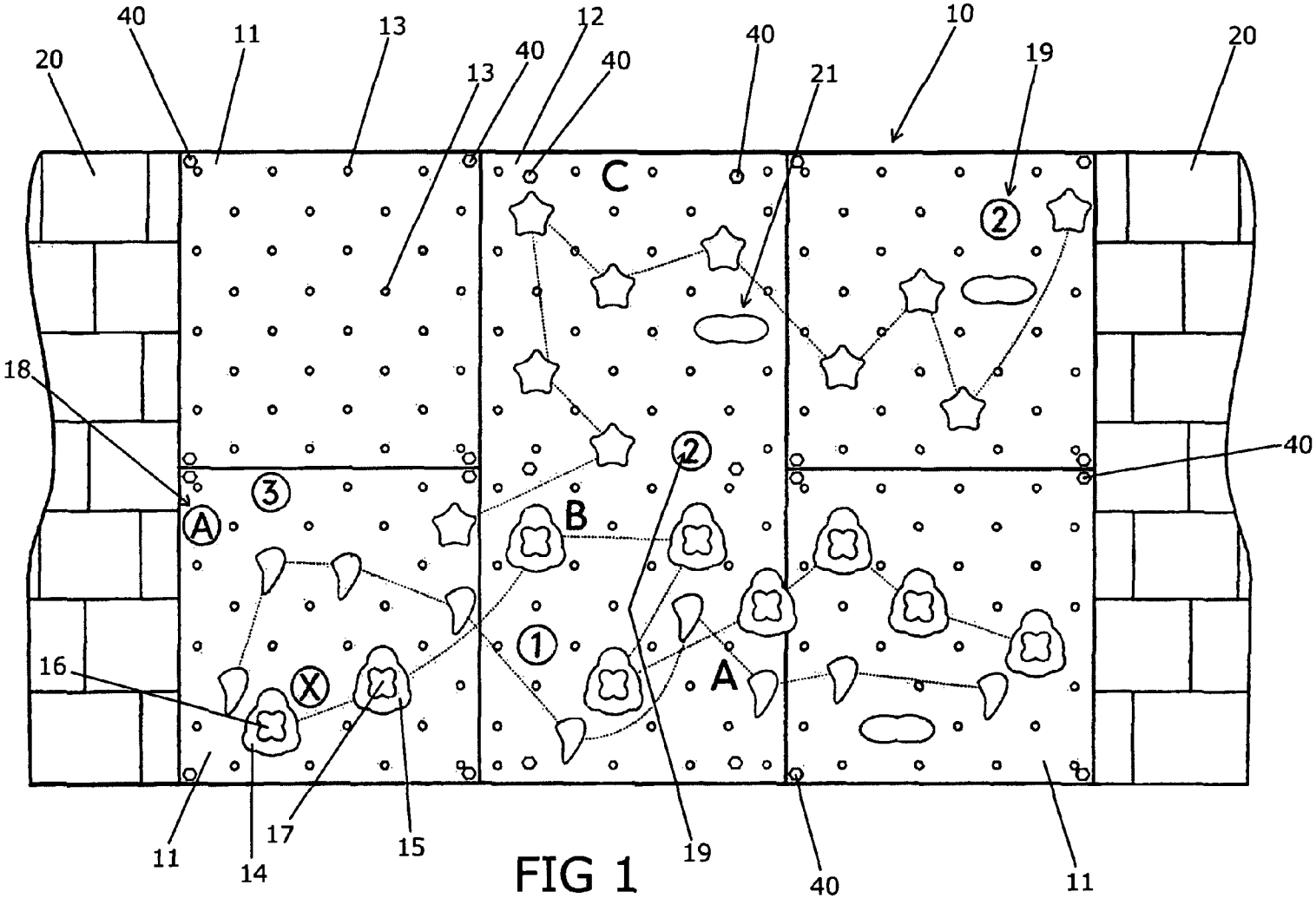
FIG. 1 is a plan view showing the climbing wall assembly of the present invention mounted to a structural wall of a building.

Referring to FIG. 1, a climbing wall assembly 10 of the present invention is shown mounted to structural wall 20. For example, the climbing wall assembly 10 may be mounted by means of bolts 40 to a concrete block or other wall structure in a school gymnasium for example. The structural wall may be provided with wooden members attached to a concrete or like wall, for example, and to which the climbing wall assembly 10 is mounted. Alternatively, the wall assembly 10 may be mounted to a free standing structural member or the climbing wall may be created directly on a concrete block wall or like wall structure.

Figure 2:
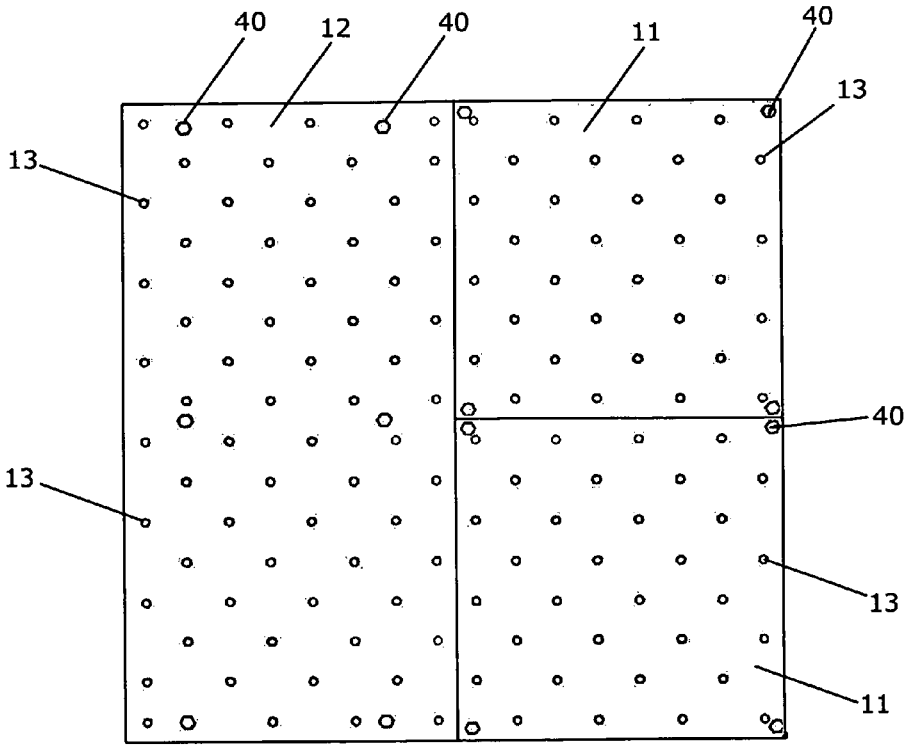
FIG. 2 is a plan view showing adjoining wall panel structures of the present invention.

Referring to FIGS. 1 and 2, the climbing wall assembly 10 is shown comprised of a plurality of adjoining individual wall panels 11 and 12. For example, the wall panels 11 may be 4 ft.×4 ft. sized panels and panels 12 may be 4 ft.×8 ft. sized panels. These rectangular wall panel areas are exemplary of wall panels that may be joined adjacently to form a climbing wall. The individual panels 11 and 12 are shown mounted in a side by side arrangement and may be of any height and length to accommodate a particular building wall area or to provide a climbing wall having a particular area, i.e., 40 ft. long and 8 ft. high.

Each wall panel 11 and 12 is shown to have a plurality of apertures 13 which are shown in a predetermined pattern covering the entire area of an individual panel. These apertures 13 have means to connect the wall plate structures 14 and 15 and hand holds 16 and 17 to the individual wall panels. The pattern of apertures 13, thereby permit the wall plates and hand holds to be mounted to wall panels in any desired pattern to thereby permit a multiplicity of climbing routes to be created. Wall panel 12 is shown having a plurality of spaced apertures 13 which are arranged in a pattern and positioned and adapted to receive the wall plates and hand hold structures. Each aperture 13 preferably has means, such as a T-nut structure fixed therein or having other fastening means, for mounting the wall plates and/or hand hold structures to the climbing wall surface. Further, fastening bolts 40 are shown for securing the wall panel 12 through wall panel mounting apertures to a building wall structure, if desired. The wall panels may be otherwise secured to a wall by known means or alternatively mounted to a free standing frame structure or other substructure. For example, expandable, threaded, sleeve/bolt fasteners or an elongated bolt/nut fastener may extend through a concrete or block wall to fasten hand holds, wall plates, and like elements. Other fasteners known in the fastening art, such as screws, may also be utilized to secure hand holds and other components to a climbing wall structure.

Figure 3:
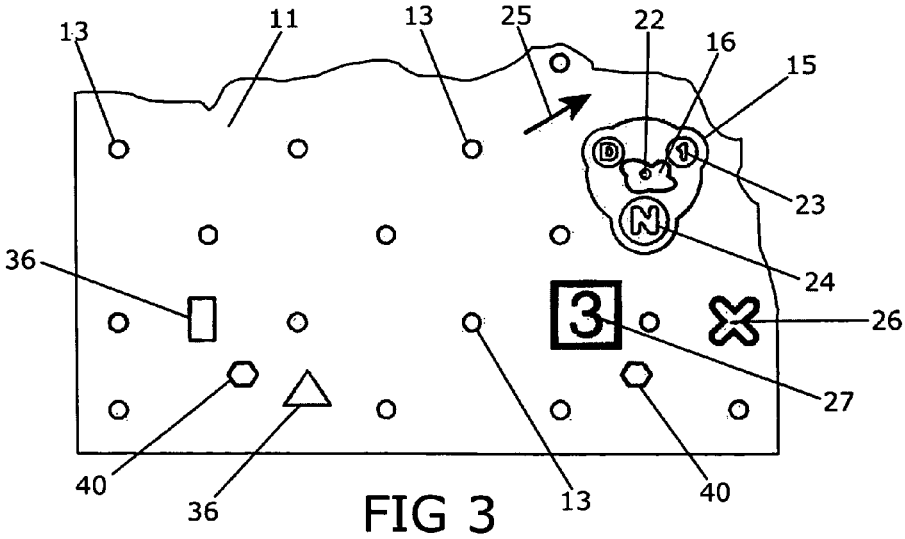
FIG. 3 is a plan view showing a wall panel, a plate structure, hand hold and educational elements of the invention.

Referring to FIGS. 1 and 3, an individual wall panel 11 may have a number of educational elements which are movably attached to either the surface of the wall panel 11 or to the components mounted to the wall panel 11, i.e., wall plate 15 and hand hold 16. For example, as shown, magnetic geometric shapes 36, magnetic letters 18, 26 and magnetic numerals 19, 27 may be attached to the surface of wall panel 11. Further, as shown, wall plate structure 15 may have removable letter insert 24 therein. The hand hold 16 and wall plate 15 structures are shown mounted to the wall panel 11. Individual hand hold structures 21 are also shown mounted to wall panel 12.

Figure 4:
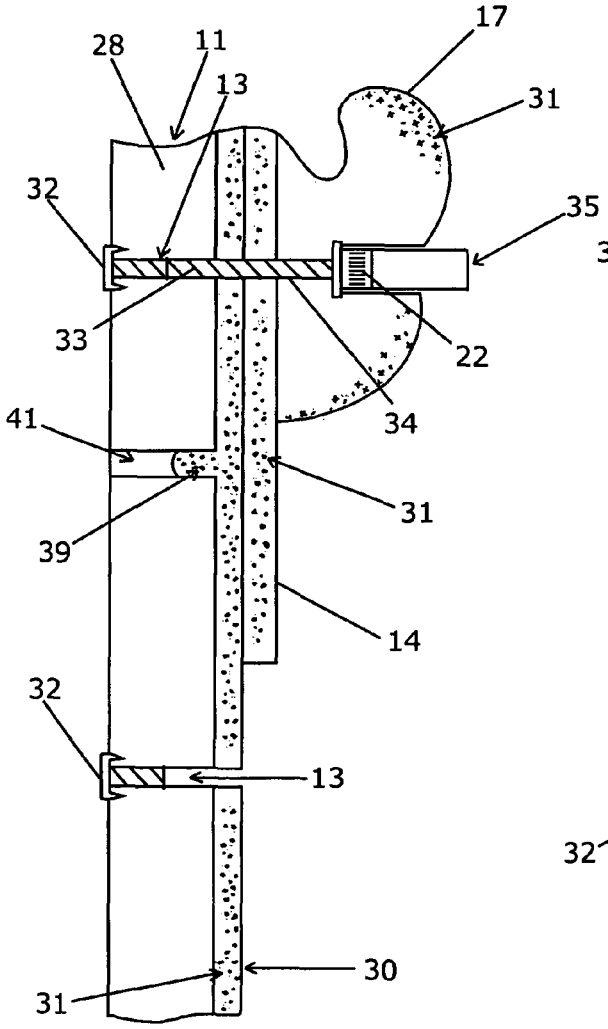
FIG. 4 is a sectional view of a wall panel of the present invention.

FIG. 4 is a sectional view showing the wall panel 11 and the wall plate structure 14 and hand hold 17 mounted to the wall panel 11. The wall panel 11 is shown comprised of a base structure 28, i.e., a sheet of plywood (¾ inch thickness, for example) and an outer layer 30 molded to the base structure 28. The outer layer 30 is preferably of a urethane or similar plastic composition, for example. The surface of the plastic layer 30 may also be constructed to receive markings 25, for example, as shown in FIG. 3, to thereby allow a climber to physically mark a route. The molded wall panel 11 is further shown having a plurality of T-nuts 32 attached to the back of the base structure 28 and positioned in apertures 13. T-nuts 32 are metallic structures having internal threads for receiving bolts 33 having bolt heads 22. The bolts 33 are shown to attach the hand holds 17 and wall plates to the wall panel 11. As further shown, a magnetic rod elements 35 may be used on bolt head 22 of bolt 33 and to extend from the hand hold 17 for marking use by climbers.

Figure 8:
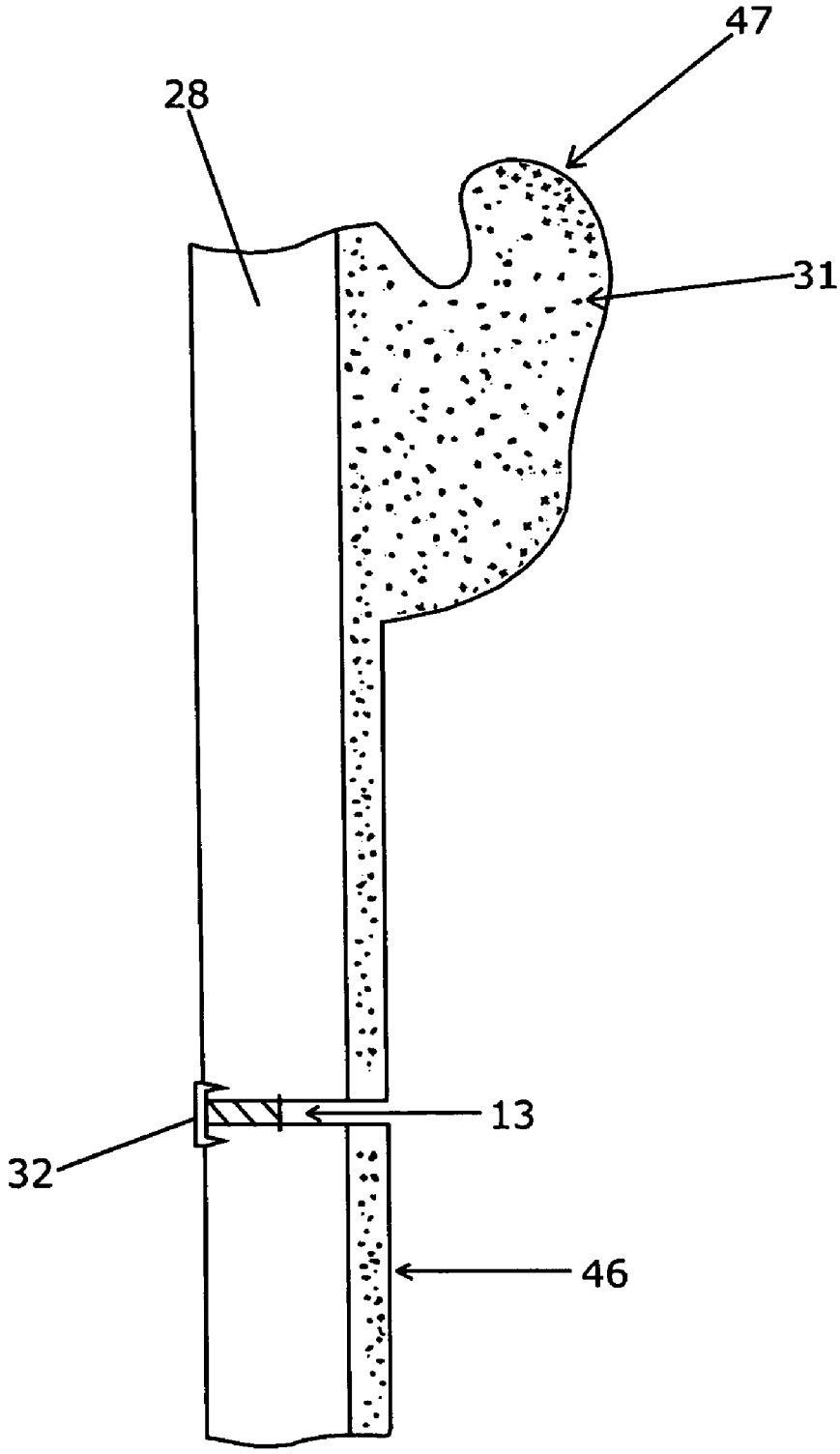
FIG. 8 is a sectional view showing another wall panel embodiment.

One embodiment of the wall panels 11 and 12 are preferably molded in an operation that generally comprises mixing a two part urethane resin, for example, and pouring the liquid resin in a mold, such as a silicone mold. Next, a base member 28, for example, a sheet of ¾ inch plywood, MDF (medium density fiberboard), a sheet of plastic, a sheet of metal, a sheet of composite wood/plastic or a combination thereof is placed on top of the urethane mixture in the mold. Upon curing of the urethane mixture, the wall panel is formed. In molding the wall panels 11 and 12 the bottom surface of the mold preferably has spaced protrusions extending therefrom to form apertures or holes in the outside surface of the urethane layer 30 and which are subsequently used to drill through the base structure 28 to form the apertures 13 in the wall panels 11 and 12. Alternatively, the wall panel may be formed of a one piece molded plastic structure. This process or other molding processes may also be utilized to provide wall panels having molded handhold structures unitary with the panels, as shown in FIG. 8.

Figure 5:
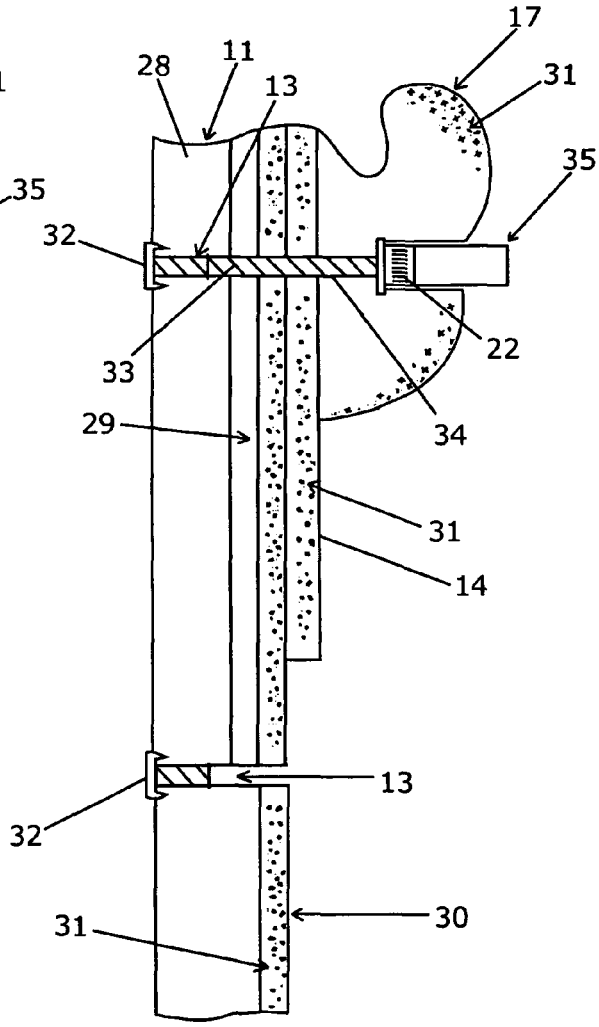
FIG. 5 is a sectional view showing another wall panel embodiment.

As shown in FIG. 5, the base structure 28 may also be laminated to the molded urethane panels by means of a layer 29 of urethane resin. Alternatively, an adhesive or mechanical means may be used to secure the urethane panel to the base structure 28. As will be further discussed, other panels, such as writing boards may be secured to the base structure 28 to form a wall panel.

In the above referenced molding process, the base structure 28, i.e., plywood panel, is initially provided with a plurality of apertures 41 to provide air holes (i.e. randomly or uniformly spaced apertures in the base structure) to thereby provide the nubs 39 in the molded urethane 30 and which protrude into the air holes 41 and also to aid in securing the urethane panel and base member together, as shown in FIG. 4. The mold used in the manufacture of the wall panels, wall plates and hand holds are preferably constructed of a silicone structure or the like. The mold may further have a smooth or rough surface, may be flat or planar or may have a profile to assimilate a rock form. The wall plates and hand hold structures are also formed in a mold of a urethane resin, however, the wall plate and hand hold members do not utilize a base member, i.e, plywood, and instead are comprised of a molded urethane structure, or like molded plastic.

The urethane resin preferably has metallic particles, such as pellets or the like, mixed therein so that the molded panel, plates and hand holds will have metallic properties. In addition or alternatively, the metallic elements may be dropped into the resin after the resin has been poured into the mold. As further discussed below, aggregate may also be added so as to provide textured wall surfaces.

Although the wall panels of the invention and the process of manufacturing the wall panel, hand holds and wall plates are described as having metallic particles placed therein for subsequent use with magnetic elements, magnetic walls, hand holds and plates may be used instead and the educational pieces may have metallic or magnetic elements incorporated therein for use with the magnetized panels, plates and hand hold elements. Regarding the magnetic elements used in the invention, preferably earth magnets are utilized for their magnetic strength. Metallic objects may be used on wall surfaces and on surfaces of associated elements having magnetic properties, i.e., on handholds, wall or route plates, etc. Magnetic objects may be used on these surfaces having metallic properties or magnetic properties of opposite polarity.

Referring further to FIG. 4, the outer urethane layer 30, the plate structure 14 and the inner surface of the hand hold 17 are shown to have metallic particles 31 embedded therein so that magnetic pieces may be held thereto according to the teachings of the present invention.

The wall panel exterior surfaces of the present invention are constructed and arranged to have educational writing board capabilities. These surfaces include chalkboard, i.e., blackboard and "white board" surfaces, either with metallic and/or magnetic qualities to thereby provide marking capability as well as providing the use of magnetic and/or metallic educational elements. Acrylic or enamel paints or coatings may also be utilized to create these surfaces.

The markers that may be utilized with the writing board surfaces may include dry erase, write-on/wash-off type markers, crayons, pens, pencils, removable paint and like markers. The latter marking devices are utilized by and familiar to students and such and like writing utensils are preferred for use with this invention. Further, stickers may also be utilized such as those having adhesive release qualities.

Figure 12:
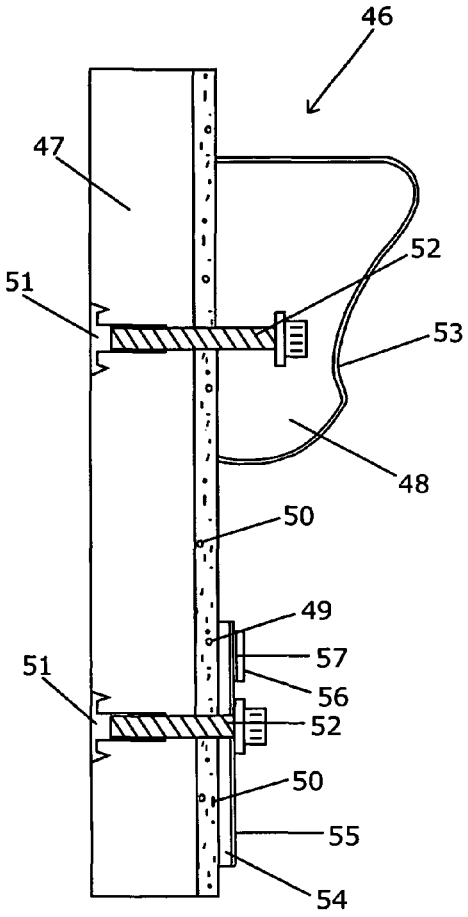
FIG. 12 is a sectional view showing a climbing wall panel, handhold structure, wall plate structure and educational element each having a painted layer with magnetic or metallic particles embedded therein.

Although writing boards having hard glossy surfaces, such as a plastic, melamine or porcelain composition are often referred to as "white boards", such surfaces may be provided in any desired color. Likewise, chalkboards having smooth surfaces usually made of slate, glass or wood compositions for crayons or chalk are often referred to as "black boards", may also be provided in any desired color. These writing board surfaces although normally flat, may also be contoured and may include formed handhold structures. Further, these writing surfaces may be placed onto a base structure via lamination, paint spray, or the like and may include an underlying layer of a metallic or magnetic composition whereby both writing and magnetic and/or metallic educational elements may be utilized by the climbers. Alternatively, as shown in FIG. 12, the exterior layer may be a paint or coating layer having metallic or magnetic particles mixed therein to provide an exterior surface with magnetic or metallic properties. As further discussed below, an aggregate may be included into the exterior paint or coating layer so as to provide a textured surface.

Figure 6:
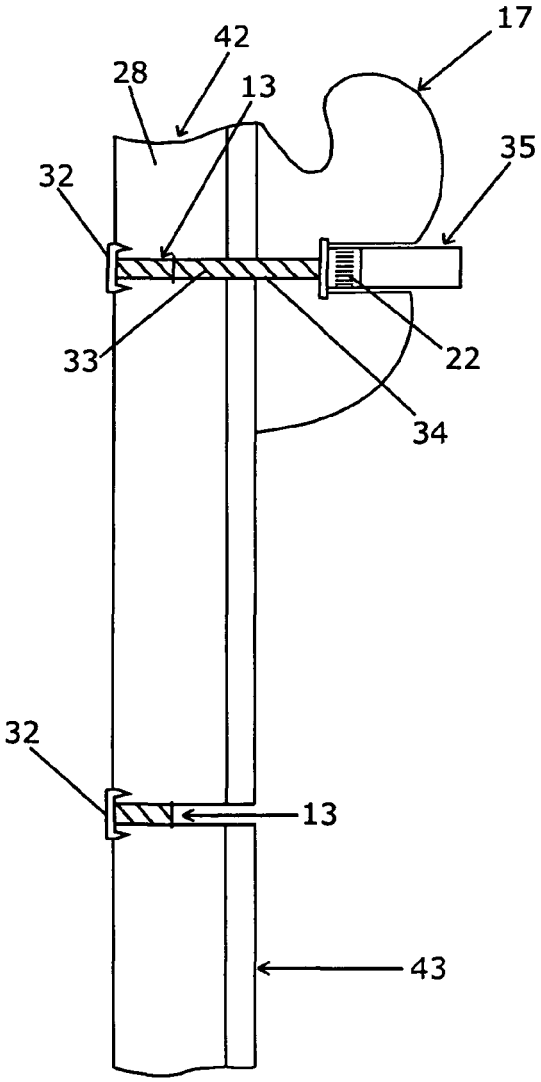
FIG. 6 is a sectional view showing an alternative wall panel embodiment.

FIG. 6 is a sectional view showing wall panel 42 having base structure 28 having a "chalkboard" surface 43 affixed thereto. The surface 43 may be fixed by means of adhesive or other fastening means to the base structure 28, i.e., a sheet of plywood or other base structure. Apertures 13 having T-nuts 32, or other fastening means, are similarly shown having hand hold 17 mounted to the wall panel 42.

Figure 7:
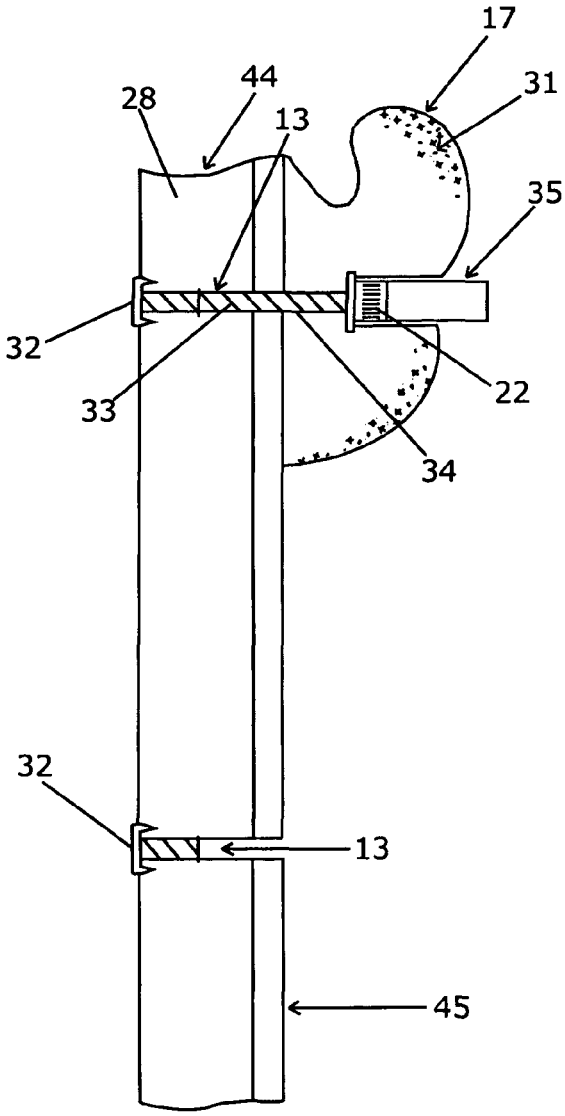
FIG. 7 is a sectional view showing another wall panel embodiment.

FIG. 7 is a sectional view having wall panel 44 having a base structure 28 having a "white board" surface 45 affixed thereto. The white board surface 45 is a hard impermeable plastic material adapted to receive markings, i.e., from erasable markers utilized in classrooms, for example.

The climbing wall assemblies of the invention may include adjoining wall panels having like exterior surfaces or adjoining wall panels having different exterior surfaces. The latter wall panel different surface arrangement, whether different in color, different in marking ability, or having different properties, i.e. magnetic, non-magnetic, textured, non-textured, can be utilized for educational purposes; for example, identification of the different surfaces by the climbers via the use of the appropriate corresponding educational elements by placement on specific wall surfaces.

FIG. 8 is a sectional view showing base structure 28 having molded layer 46 attached thereto. Importantly, hand hold structure 47 is shown unitarily molded with layer 46. Alternatively, base structure 28 may be eliminated by increasing the thickness of molded layer 46 to thereby provide a structural element. Further, metallic particles 31 are shown in layer 46. As discussed, magnetic particles may also be utilized in layer 46 or a metallic or magnetic layer may be disposed between base structure 28 and molded layer 46 to yield metallic or magnetic properties for use with corresponding educational elements. T-nut 32 is shown positioned in aperture 13 whereby wall plates, for example, may be mounted to the structure.

Figure 9:
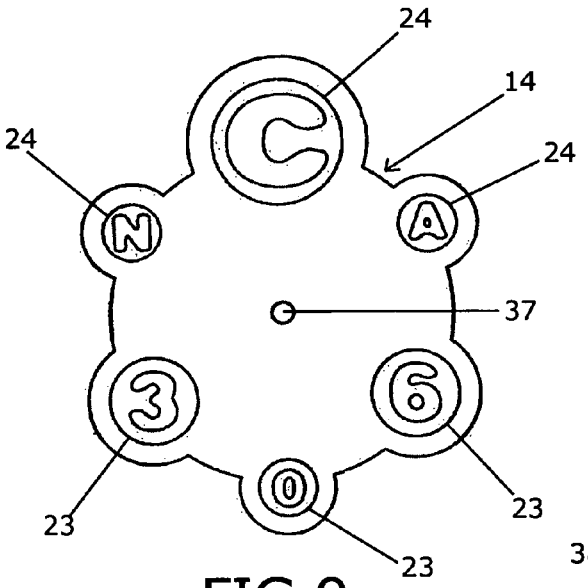
FIG. 9 is a plan view showing a plate structure used in the climbing wall assembly of the invention.
Figure 10:
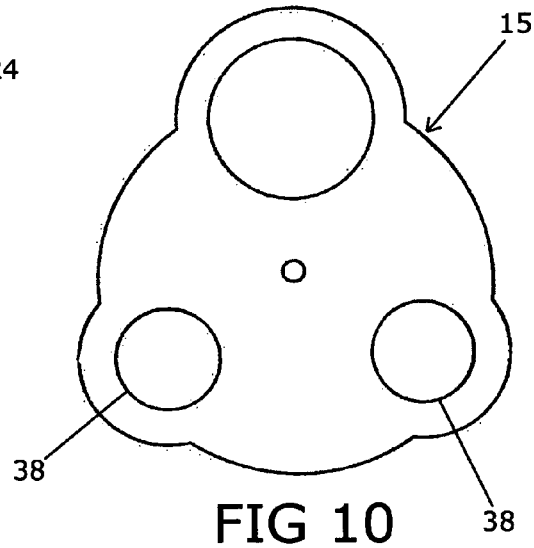
FIG. 10 is a plan view showing another plate structure used in the climbing wall assembly of the invention.
Figure 11:
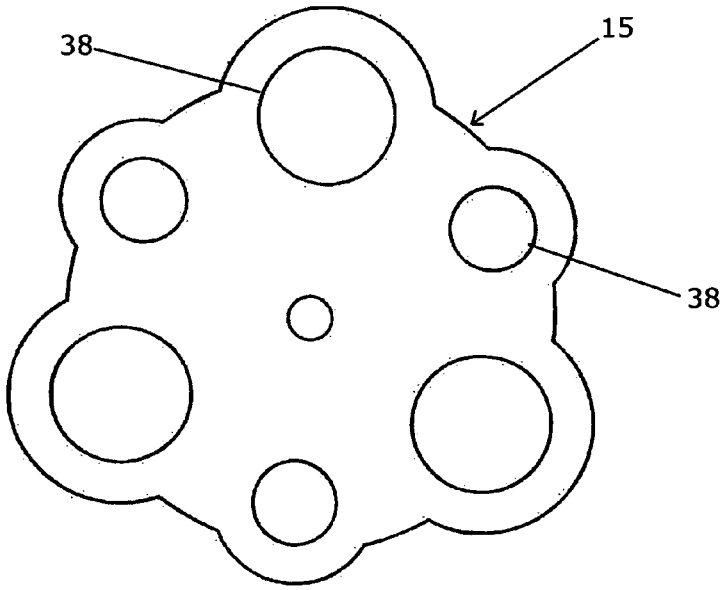
FIG. 11 is a plan view showing another plate structure used in the climbing wall assembly of the invention.

FIG. 9 is a plan view showing a wall plate structure 14 having a geometric shape having an aperture 37 for mounting the wall plate 14 to a wall panel 11, for example, and having a plurality of removable numerical insert discs 23 and a plurality of removable letter inserts 24 which are placed in circular apertures in the periphery of the wall plate structure 14. Further, FIGS. 10 and 11 show other geometrically shaped wall plates 15 having peripheral apertures 38 for receiving the numerical and letter inserts.

The route plates 14, 15 used in the climbing wall assembly 10 of the invention are designed for use in educational climbing wall activities. The wall or route plates 14, 15 may be mounted between the climbing wall panel 11 and the climbing hand hold 16. The route plates 14, 15 are affixed to the wall panel 11 in a similar manner as a hand hold, for example, with a ⅜", 16 thread socket head cap screw, i.e., bolt 33. Each bolt or screw 33 passes through an enlarged aperture 34 of a hand hold structure 17. This dimension may be larger than a standard hole or may be slotted to enable the wall plate 14, 15 to be adjusted so that the hand hold 17 does not cover any of the discs 23, 24, six for example, and so that each plate 14 can be separated from nearby plates, i.e., 15. For example, 30-50 route plates 14, 15 may be used on a 40-foot traverse climbing wall.

FIG. 12 shows the climbing wall structure 46 of the present invention comprising wall base member 47 with a paint layer 49 having particles 50 mixed therein. The wall base member may be constructed of ¾ inch plywood or a like base material. The paint particles 50 may be metallic or a magnetic particles which set within the dried paint or coating layer. Hand hold 48 is shown attached to wall base member 47 by means of a T-nut 51 and cooperating bolt 52. The hand hold 48 is shown having an exterior surface 53 which has magnetic or metallic particles. Further, a wall plate 54 is shown having and exterior surface 55 having magnetic or metallic particles. An educational element 56 having an exterior surface 57 with magnetic or metallic particles is shown used on wall plate 54. The paint layers 49, 53, 55 and 57 may be acrylic, enamel or other type of paint media and may be sprayed, brushed, rolled or otherwise applied on the climbing wall surface. These paints or coatings may also provide writable surfaces as described above. The paint layer with the magnetic or metallic particles may also be applied to any surface or substructure, for example, a wall plate, a hand hold, a plywood climbing wall or a block or formed concrete gymnasium wall. The painted climbing wall and component surfaces permit educators and students to place and remove magnetic objects for educational purposes as described herein. Magnetic or metallic objects may be used in climbing routes and marked for math, language or other educational activities that may be conducted and played.

The wall plate structures of the present invention may also be utilized on any other climbing wall structures. For example, the wall plate structures and associated educational elements, whether metallic, magnetic or frictional fit may be mounted via any fastening means, i.e., mechanical, adhesive, etc., to known wall climbing structures to provide educational aspects and uses by young climbers, for example.

After attachment to the wall panels 11, the wall plates 14 and the inset discs 24, which are preferably brightly colored, are easily visible to climbers. The different colored discs 24 may be utilized to differentiate varying climbing routes, i.e., A, B, C or to designate the difficulty of the route. For example, hand holds "marked" with green discs may show a beginner climbing route, i.e., route A, and holds "marked" with red discs may show an advanced climbing route, i.e., route C. Alternatively, the colors may be used to signify a particular climber that created the route. Route setting and resetting is an integral part of utilizing the climbing wall assembly 10 of the invention for educational and recreational purposes.

Another application for the route wall plates involves using lettered discs 24 and numbered discs 23. For example, a complete alphabet set (A-Z) and the numbers 0-9 may be utilized in the present invention. Use of the numerical discs 23 and letter discs 24 facilitates spelling and number games on the climbing wall and eliminates the difficulty and inconvenience of creating and using paper letters and numbers tucked under the hand holds. The letters and numbers on the discs 23, 24 are preferably raised and textured and mounted on a body having a predetermined size and shape, so the discs are easily inserted and removed by the climber.

The wall route plates 14, 15 may be approximately 0.25" thick and approximately 8 inches wide and 10 inches long. Each route plate 14, 15 may have six removable discs (i.e., 23, 24), for example, set inside and along the outer edges of the plastic plate structure 14 as shown in FIG. 9. The diameters of the discs may be as follows: one at 3", two at 2" and three at 1.25". The discs 23, 24 may have six different colors, for example. Smaller versions and other shapes of the wall route plate may also be utilized.

Figure 13:
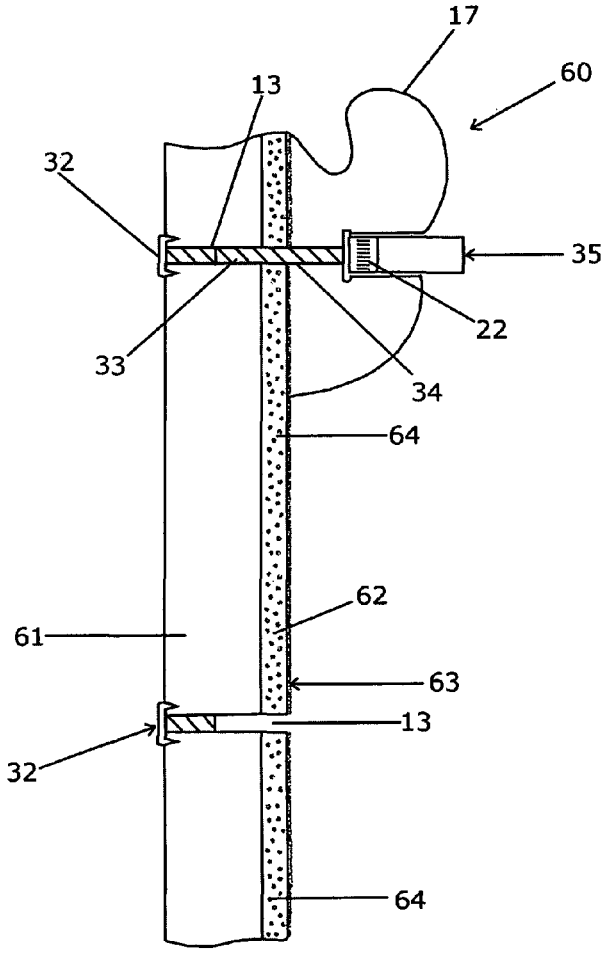
FIG. 13 is a sectional view showing a climbing wall having a textured wall surface.

FIG. 13 shows climbing wall structure 60 comprising a panel 61, and a paint/aggregate layer 62 producing a textured surface 63. The textured surface 63 described herein may be utilized in the climbing structures previously described as well as on other climbing wall structures. The textured surface 63 is comprised of aggregate particles 64 which are applied and incorporated within the paint layer.

Aggregate material used in the paint/aggregate mixtures may be hard inert granular materials or particles such as silica, sand, cement, crushed stone, crushed gravel particles and the like which are small and varied in size and shape. The aggregate particles may be added to a paint formulation.

The aggregate materials may also be glass bead mixtures which are clear or crystal and composed of a mixture of primarily silica ($SiO_2$) and with Sodium Oxide ($Na_2O$), Calcium Oxide (CaO), Magnesium Oxide (MgO) and the like. The silica or glass bead aggregate particles may, for example, be provided in paint mixtures available from paint manufacturers which incorporate these aggregate particles into paint formulations, i.e., in urethane paints. The paint formulations may also be latex, epoxy or oil based and have a predetermined amount of aggregate in the paint mixture. For example, a range of approximately 3-40 wt % aggregate may be included in the aggregate/paint mixture with a preferred range of 10-15 wt %. The aggregate or glass bead particles may be 60/100 mesh particles (254/122 microns) in size, for example, and may be comprised primarily of silica, for example, a minimum of 67% silica. The glass beads may be clear or crystal so that the paint color provides the wall surface color. Other particle sizes may also be utilized, smaller or larger, i.e., 50/70, 60/200, 70/140 mesh, etc.

To provide the paint/aggregate/metallic-magnetic particle mixture, magnetic or metallic particles may be added to the paint/aggregate mixture to thereby provide a mixture containing 10-50% magnetic or metallic particles by volume. For example, magnetic particles or metallic particles or powder may be added to the paint/aggregate mixture in a two (aggregate/paint) to one (magnetic/metallic particles) volumetric ratio, thereby providing approximately 33% by volume magnetic or metallic particles, to provide the desired aggregate/paint/metallic or magnetic particle mixture for the climbing wall surface of the invention.

The textured wall surface 63 provides a natural rock look and feel. The paint layer described above may be sprayed, brushed, rolled, trowelled or otherwise applied to a climbing wall base. The paint/aggregate mixture may also include metallic or magnetic particles to provide the surface described above with respect to the magnetic/metallic educational elements. The textured exterior surface 63 provides a frictional surface for handhold 17 so as to further stabilize the hold body, for example, by reducing the ability of rotational movement with respect to bolt 33. The textured surface 63 also provides a climber with the ability to utilize smearing techniques on the climbing wall assembly. The textured surface 63 provides a frictional surface for the climber's body to permit this climbing technique to be used.

As many changes are possible to the embodiments of the assemblies of this invention utilizing the teachings thereof, the descriptions above, and the accompanying drawing should be interpreted in the illustrative and not in the limited sense.

That which is claimed is:

1. A climbing wall assembly comprising:

a) a plurality of fixed wall panels arranged in an adjacent wall panel configuration, each said wall panel having an exterior wall surface adapted for educational purposes and further having a plurality of apertures therethrough for providing means to create a plurality of climbing paths, each said aperture having a fastening element embedded therein and integral the wall panel;

b) a plurality of handhold structures each having a body with a curved grabbing surface and an aperture therein for having a fastening element extending there-through to cooperate with said embedded fastening element in said wall panel for mounting said hand holds to said wall panels;

c) said exterior wall surface comprising a paint/aggregate layer on said plurality of fixed wall panels, said paint/aggregate layer composition comprising approximately 3-40 weight percent aggregate particles; and d) a plurality of educational elements including numbers, letters, words and geometric shapes, said educational elements removably cooperating with said wall panel and having a property selected from the group of properties comprising a metallic property and a magnetic property, said property cooperating with said metallic or magnetic property of said climbing wall so that the educational elements are readily attached to and removed from said exterior surface of said climbing wall panel.

2. The climbing wall assembly of claim 1, wherein said aggregate particles comprise silica particles and range in size from approximately 20 to 200 mesh.

3. The climbing wall assembly of claim 2, wherein said paint/aggregate layer further comprises particles having metallic or magnetic properties and wherein said paint aggregate layer having said magnetic or metallic properties comprises approximately 10-50% metallic or magnetic particles by volume.

4. The climbing wall assembly of claim 1, wherein said paint/aggregate layer provides the look and feel of natural stone on said climbing wall panels and wherein said paint is selected from the group of paints consisting of urethane, latex, epoxy and oil based paints.

5. The climbing wall assembly of claim 1, wherein said handhold structures each have a generally flat mounting surface and wherein said paint/aggregate layer provides stabilization to each said hand hold structure by providing a textured surface to frictionally engage said generally flat mounting surface of said hand hold structure.

6. The climbing wall assembly of claim 1, wherein said each said hand hold structure has an exterior surface having magnetic or metallic properties.

7. The climbing wall assembly of claim 1, wherein said embedded fastening element is comprised of a T-nut structure constructed to be fixed in each said plurality of apertures of said wall panels.

8. A climbing wall assembly comprising:

a) a climbing wall having at least one mounting aperture with a cooperating fastening element, said climbing wall having a textured exterior surface comprising a paint layer with an aggregate content and with magnetic or metallic properties adapted for educational use;

b) at least one hand hold structure having a body having a generally flat mounting surface and a curved exterior grabbing surface extending from said generally flat mounting surface, wherein said hand hold body is secured to said climbing wall having said generally flat mounting surface abutting said textured wall surface and having a fastener extending through said hand hold body;

c) a plurality of educational elements each having an exterior surface portion having metallic or magnetic properties, said metallic or magnetic exterior surface portion constructed and arranged to cooperate with said magnetic or metallic paint layer of said climbing wall so that said educational elements are readily attachable to and removable from said climbing wall, said educational elements including removable numbers, letters, words and geometric shapes; and d) whereby said textured exterior surface provides a frictional surface for said generally flat mounting surface of said at least one hand hold structure body and for providing a natural climbing surface to provide a climber with means to engage in smearing techniques.

9. The climbing wall assembly of claim 8, wherein said paint layer is urethane based and wherein said aggregate size ranges from 20 to 200 mesh.

10. The climbing wall assembly of claim 9, wherein said aggregate particles comprise silica particles.

11. The climbing wall assembly of claim 8, wherein said paint layer contains 10-50% by volume magnetic or metallic particles.

12. The climbing wall assembly of claim 8, wherein said climbing wall has a plurality of mounting apertures therethrough for providing means to create a plurality of climbing paths and further wherein said fastener is a bolt member.

13. The climbing wall assembly of claim 8, wherein said cooperating fastening structure comprises a T-nut structure.

14. The climbing wall assembly of claim 8, wherein said educational elements have an exterior surface comprising a paint layer having metallic or magnetic properties.

15. The climbing wall assembly of claim 9, wherein said hand hold structure further has an exterior paint layer with aggregate and metallic or magnetic properties and further wherein said paint layer provides a writable surface.

16. A climbing wall assembly comprising:

a) a fixed climbing wall having an exterior wall surface and having a plurality of apertures therethrough for providing means to create a plurality of climbing paths, each said aperture having a fastening element embedded therein and integral the climbing wall;

b) a plurality of handhold structures each having a body with a curved grabbing surface, a generally flat mounting surface and an aperture therein for having a fastening element extending there-through to cooperate with said embedded fastening element in said climbing wall for mounting said hand hold to said climbing wall;

a paint/aggregate layer on said exterior wall surface of said climbing wall, said paint/aggregate layer including particles having magnetic properties, thereby creating an exterior climbing wall surface capable for use with cooperating magnetic or metallic elements; and d) said paint/aggregate layer with said particles having magnetic properties providing a non-smooth textured frictional surface on said climbing wall surface to provide the look and feel of natural stone on said climbing wall surface to thereby provide a climber with a textured, frictional surface to allow smearing techniques and to frictionally engage said generally flat mounting surface of said handhold structures for antirotational, stabilization purposes.

17. The climbing wall assembly of claim 16, wherein said paint/aggregate layer composition contains 3-40 weight percent aggregate particles.

18. The climbing wall assembly of claim 17, wherein said paint/aggregate layer further comprises particles having metallic or magnetic properties and wherein said paint aggregate layer having said magnetic or metallic properties comprises approximately 10-50% metallic or magnetic particles by volume.

19. The climbing wall assembly of claim 16, wherein said paint layer is urethane based and wherein said aggregate size ranges from 20 to 200 mesh.

* * * * *